US005916720A

United States Patent [19]

Springett

[11] Patent Number: 5,916,720

[45] Date of Patent: Jun. 29, 1999

[54] IMAGING MEMBER HAVING A DUAL METAL LAYER SUBSTRATE AND A METAL OXIDE LAYER

[76] Inventor: Brian E. Springett, 28 Fair Oaks Ave., Rochester, N.Y. 14618

[21] Appl. No.: 08/963,953

[22] Filed: Nov. 4, 1997

[51] Int. Cl.[6] ..... G03G 5/14

[52] U.S. Cl. ..... 430/63; 430/65

[58] Field of Search ..... 430/63, 65, 58

[56] References Cited

U.S. PATENT DOCUMENTS

| | | | |
|---|---|---|---|
| 2,809,294 | 10/1957 | Vyverberg | 430/63 |
| 4,764,442 | 8/1988 | Otomura et al. | 430/63 |
| 4,770,964 | 9/1988 | Fender | 430/65 |
| 4,800,144 | 1/1989 | Ueda et al. | 430/58 |
| 5,215,853 | 6/1993 | Andrews et al. | 430/131 |
| 5,219,691 | 6/1993 | Fukuda et al. | 430/58 |
| 5,532,093 | 7/1996 | Yuh et al. | 430/58 |
| 5,654,118 | 8/1997 | Yuh et al. | 430/58 |

*Primary Examiner*—Christopher D. Rodee
*Attorney, Agent, or Firm*—Zosan S. Soong

[57] ABSTRACT

An electrostatographic imaging member composed of: (a) a substrate having a metal surface; (b) a metal layer having less than about 1% by weight oxygen atoms based on the weight of the metal layer, bonded to the substrate metal surface, and wherein the metal layer has a composition different from the substrate metal surface; (c) a charge blocking layer including a metal oxide over the metal layer, wherein the charge blocking layer fails to function also as a light reflection preventive layer; and (d) at least one imaging layer.

18 Claims, No Drawings

IMAGING MEMBER HAVING A DUAL METAL LAYER SUBSTRATE AND A METAL OXIDE LAYER

FIELD OF THE INVENTION

This invention relates to an electrostatographic imaging member, especially one employing a charge blocking layer composed of a metal oxide.

BACKGROUND OF THE INVENTION

It is common to employ aluminum or aluminum alloy as the substrate material of electrostatographic imaging members due to the lower cost of aluminum or aluminum alloy as compared with for example a nickel substrate. A known technique for creating a charge blocking layer on the substrate is by anodizing the surface of the aluminum substrate to create a layer of aluminum oxide. There is a need, which the present invention addresses, to expand the design parameters for imaging members by allowing different combinations of materials to be used for the substrate and the metal oxide layer functioning as the charge blocking layer. Such a blocking layer then allows subsequent layers to perform a single function such as adhesion or suppression of light interference fringes rather than having to provide dual functions which often result in a design compromise.

The following patents disclose conventional imaging members: Fukuda et al., U.S. Pat. No. 5,219,691; Andrews et al., U.S. Pat. No. 5,215,853; Yuh et al., U.S. Pat. No. 5,654,118; Yuh et al, U.S. Pat. No. 5,532,093; and Ueda et al., U.S. Pat. No. 4,800,144.

SUMMARY OF THE INVENTION

The present invention is accomplished in embodiments by providing an electrostatographic imaging member comprising:

(a) a substrate having a metal surface;

(b) a metal layer having less than about 1% by weight oxygen atoms based on the weight of the metal layer, bonded to the substrate metal surface, and wherein the metal layer has a composition different from the substrate metal surface;

(c) a charge blocking layer including a metal oxide over the metal layer, wherein the charge blocking layer fails to function also as a light reflection preventive layer;and (d) at least one imaging layer.

DETAILED DESCRIPTION

A preferred structure of the imaging member is as follows: a substrate having a metal surface, a metal layer over the substrate metal surface, a blocking layer over the metal layer, a charge generating layer over the blocking layer, a charge transport layer over the charge generating layer. The imaging member may also include one or more additional layers typically employed in a photoreceptor including for example an adhesive layer, an anticurl layer, and an overcoat layer. In alternate embodiments of the present invention, the charge transport layer is adjacent to blocking layer with the charge generating layer over the transport layer. Embodiments wherein the charge generating and transport functions are combined into a single layer are also included. The operating mode of all structures may be by image-wise discharge by analog or digital exposure sources from either a positively or negatively charged state in order to create an electrostatic image.

A description of suitable materials for the imaging member of the present invention, as well as illustrative processes for preparing the imaging member, follows.

SUBSTRATE

The substrate can be formulated entirely of an electrically conductive metal material or it can be an insulating material having a coating thereon of an electrically conductive metal. Any suitable electrically conductive metal material can be employed such as copper, brass, nickel, magnesium, zinc, chromium, stainless steel aluminum, steel, titanium, silver, gold, and alloys of these metals. In the embodiments where the substrate is an insulating materials having a coating thereon of a metal, examples of insulating non-conducting materials include polycarbonates, polyamides, polyurethanes, paper, glass, plastic, polyesters such as MYLAR® (available from DuPont) or MELINEX 447® (available from ICI Americas, Inc.), and the like. The substrate can have any number of configurations such as a solid rod, a hollow cylinder having open ends, an endless flexible belt, and the like.

The substrate can be fabricated by an electrodeposition process including electroplating or electroforming. Electrodeposition processes, such as electroforming processes, are illustrated in Bailey et al., U.S. Pat. No. 3,844,906, and Herbert, U.S. Pat. No. 4,501,646, the disclosures of which are totally incorporated by reference.

METAL LAYER

The metal layer may be composed of any of the metals or alloys described for the substrate. Preferably, the metal layer is composed of nickel, copper, hafnium, indium, palladium, tantalum, tin, titanium, zinc, zirconium, or vanadium, or alloys of these metals. Typical alloys are Cu:Ni wherein the percentage of copper is in the range from about 5% to about 20%; In:Sn wherein the percentage of indium is in the range from about 5% to about 95%; Ni:Pd wherein the percentage of nickel is in the range from about 10% to about 20%. In preferred embodiments, the metal layer is essentially pure metal which may be further processed to an oxidized state. The metal layer may have less than about 1% by weight oxygen atoms, preferably less than about 0.5% by weight oxygen atoms, more preferably less than about 0.1% by weight oxygen atoms based on the weight of the metal layer; in embodiments, the metal layer may contain essentially no oxygen atoms or other impurities resulting from the deposition process.

The metal layer has a composition different from that of the substrate metal surface adjacent the metal layer. For example, the substrate metal surface is composed of an aluminum alloy and the metal layer is composed of a material having a lower concentration by weight of aluminum than the aluminum alloy employed in the substrate metal surface. As another example, the substrate metal surface is composed of aluminum or aluminum alloy and the metal layer is composed of a material that is other than aluminum or aluminum alloy such as nickel or nickel alloy. Preferably, the material used in the metal layer is readily deposited on the substrate metal surface and can be subsequently anodized or oxidized readily.

The metal layer has a thickness ranging for example from about 10 nm to about 1,000 nm, preferably from about 15 nm to about 500 nm, where nm is the abbreviation for nanometers.

The metal layer may be chemically bonded to the clean substrate metal surface by for example a electrodeposition process like electroplating or a vacuum deposition process, such processes being well known, where the overlaying metal layer is chemically integral to the metal of the substrate. In preferred embodiments, the metal layer is formed on the substrate subsequent to the fabrication of the substrate as opposed to depositing the metal layer in situ during the process of fabricating the substrate.

CHARGE BLOCKING LAYER

Since the typical organic photoreceptor structure requires negative charging for satisfactory operation, the charge blocking layer of the present invention preferably is a hole (positive charge) blocking layer capable of forming a barrier to prevent hole injection from the electrically conductive substrate to the photoconductive layer while allowing passage of electrons. Clearly, in the event that the photoreceptor structure requires positive charging for satisfactory operation, the charge blocking layer may be designed to prevent electron (negative charge) injection from the electrically conductive substrate while allowing the passage of holes.

The charge blocking layer is composed of a metal oxide such as copper oxide, nickel oxide or the oxides of any of the metals or metal alloys described herein, and optionally a metal hydroxide such as copper hydroxide, nickel hydroxide, or the hydroxides of any of the metals or metal alloys described herein. In embodiments where the charge blocking layer is formed by anodization of the surface of the metal layer, the metal of the metal oxide and any metal hydroxide will correspond to the material employed in the metal layer such that, for example, where the metal layer is nickel, the metal oxide will be nickel oxide and any metal hydroxide present will be nickel hydroxide. The charge blocking layer may be entirely composed of a metal oxide. In embodiments, both the metal oxide and metal hydroxide may be present in the following illustrative ratios by weight: metal oxide, about 80% to about 99%, and preferably about 90% to about 95%; and metal hydroxide, about 1% to about 20%, and preferably about 5% to about 10%.

The charge blocking layer for the present invention is too thin to effectively function also as a light reflection preventive layer. Such a light reflection preventive layer is useful in eliminating or reducing the well known "plywood" type of defect in output prints where there is optical interference occurring within an imaging member if the imaging source uses coherent light such as to form a solid state laser diode. Conventional techniques for reducing the "plywood" defect can be employed in the present imaging member such as introducing an additional coherent light absorbing layer (undercoat layer) immediately below the charge generator layer. The present invention avoids the need for this undercoat layer to be simultaneously a charge blocking layer. Alternatively, minimizing or eliminating the "plywood" effect may be done by suitably roughening the substrate metal surface before applying the overlaying metal layer coating. The charge blocking layer may have a thickness ranging for example from about 10 nm to about 1 micron, preferably from about 10 mn to about 100 nm, and more preferably from about 10 nm to about 50 nm.

Any suitable process can be used to form the charge blocking layer including the technique of anodization. An anodic oxidation process is described for instance in Fukuda et al., U.S. Pat. No. 5,219,691, the disclosure of which is hereby totally incorporated by reference.

An illustrative procedure for forming the charge blocking layer by anodic oxidation is as follows. An electrolytic solution is poured into an electrolytic cell made of stainless steel, hard glass, and the like to a prescribed level. The electrolytic solution which can be used for anodic oxidation is a 1 to 30% by weight, preferably 5 to 25% by weight, acidic aqueous solution of an inorganic polyproton acid selected from sulfuric acid, phosphoric acid, chromic acid, and the like or an organic polyproton acid selected from for example oxalic acid, malonic acid, oleic acid, and tartaric acid. Pure water to be used as a solvent includes distilled water and ion-exchanged water (deionized water). In order to prevent corrosion of the anodized film or production of pinholes, it is particularly required to remove impurities, e.g., chlorine, from water. Then, the substrate having for example an aluminum surface along with a stainless steel or aluminum plate are immersed in the bath of electrolytic solution to function as an anode and a cathode, respectively, with a given electrode gap therebetween similar to an electroplating cell. The electrode gap is appropriately selected from 0.1 to 100 cm. A direct current power source is prepared, and its positive (plus) terminal is connected to the surface of the anodic substrate, with the negative (minus) terminal to the cathodic plate, and electricity is passed through both electrodes in the electrolytic solution. Electrolysis is carried out either by a constant current method or by a constant voltage method. The direct current applied may consist solely of a direct current component or may comprise a combination of a direct current and an alternating current. A current density in carrying out anodic oxidation is set between 0.1 $A.dm^{-2}$ and 10 $A.dm^{-2}$. Taking the rate of film formation and cooling efficiency, a current density ranging from 0.5 to 3.0 $A.dm^{-2}$ is preferred. An anodizing voltage usually ranges from 1 to 150 V, preferably 3 to 150 V, and more preferably from 7 to 100 V. The electrolytic solution has a temperature of from −5° to 100° C. and preferably from 0° to 80° C. From the standpoint of production efficiency, production rate, film properties, and the like, the anodic oxidation is most preferably carried out in a 10 to 20% by weight sulfuric acid aqueous solution at a temperature of from 15° to 25° C. By the electrolysis process under these conditions, there is formed a porous anodized layer on the metal surface of the anodic substrate.

An alternative example for producing a dense oxide on clean hafnium or zirconium is as follows. A solution is prepared in an electrolytic cell made of stainless steel, hard glass, and the like to a prescribed level consisting of 45.4 vol. % absolute ethanol, 26.5 vol. % water, 15.2 vol. % glycerine, 7.6 vol. % lactic acid at about 85% concentration, 3.8 vol. % phosphoric acid at about 85% concentration, and 1.5 vol. % citric acid. The voltage during anodizing is allowed to reach about 200 to 300 volts. Other standard procedures are followed as in the above example.

The anodized layer generally has pores having an average diameter of about 2 to 90 nm, preferably about 5 to 40 nm and more preferably about 5 to 20 nm, and the total opening area of pores at the layer surface is generally 10 to 70%, preferably 10 to 50%, more preferably 10 to 20%, based on the entire area of the layer surface. The thickness of the porous anodized layer is controlled to fall within a range of from about 10 to about 1000 nm, and preferably from about 10 to about 50 nm, by varying, for example, the time of electrolysis.

The thus formed charge blocking layer, consisting of solid metal oxide having a thickness of about 30 nm beneath the bulk of the porous metal oxide matrix, is washed with water, and the created porosity is filled in a process referred to as sealing. Sealing creates a smooth surface which allows a uniform coating layer to be formed over it. Sealing can be accomplished by treating the charge blocking layer in an aqueous solution of nickel acetate or cobalt acetate, wherein the concentration of nickel acetate or cobalt acetate is preferably from about 0.5 to about 15 weight percent, more preferably from about 5 to about 10 weight percent. The temperature of the aqueous nickel acetate or cobalt acetate solution may be from about 50 to about 80° C. Alternatively, the created porosity in the charge blocking layer can be filled through a duplex sealing process by dipping the substrate into a boiling de-ionized water containing nickel acetate and sodium dichromate; otherwise sealing may be also achieved by soaking the substrate in 70° C. deionized water to hydrolyze the porous metal oxide.

ADHESIVE LAYER

An intermediate layer between the charge blocking layer and the adjacent imaging layer such as the charge generating layer may be desired to promote adhesion. For example, the adhesive layer preferably has a dry thickness between about 0.001 micrometer to about 0.2 micrometer. Typical adhesive layers include film-forming polymers such as polyester, du Pont 49,000 resin (available from E. I. du Pont de Nemours & Co.). VITEL-PE100™ (available from Goodyear Rubber & Tire Co.), polyvinylbutyral, polyvinylpyrrolidone, polyurethane, polymethyl methacrylate, and the like.

IMAGING LAYER(S)

The imaging layer or layers may comprise for example a photoconductive material and a charge transport material in the same layer or different layers. Illustrative photoreceptors, charge generating materials, charge transport materials, and photoreceptor fabrication techniques are disclosed for example in U.S. Pat. Nos. 4,265,990; 4,390,611; 4,551,404; 4,588,667; 4,596,754; 4,797,337; 4,965,155; and 5,004,662, the disclosures of which are totally incorporated by reference.

The photoconductive material is capable in embodiments of generating electronic charge carriers in response to the absorption of radiation to be recorded by the imaging photoreceptor. The photoconductive material may be any suitable organic or inorganic photoconductor. Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds. Suitable inorganic photoconductive materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly (N-vinylcarbazole); poly(vinylpyrene); poly(-vinyltetraphene); poly(vinyltetracene) and poly (vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene and dinitroanthraquinone.

Any suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

Any suitable technique may be utilized to apply the charge transport layer and the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. Generally, the thickness of the charge generating layer ranges from about 0.1 micron to about 3 microns and the thickness of the transport layer is between about 5 microns to about 100 microns, but thicknesses outside these ranges can also be used. In general, the ratio of the thickness of the charge transport layer to the charge generating layer is preferably maintained from about 2:1 to 200:1 and in some instances as great as 400:1.

Other modifications of the present invention may occur to those skilled in the art based upon a reading of the present disclosure and these modifications are intended to be included within the scope of the present invention.

I claim:

1. An electrostatographic imaging member comprising:

(a) a substrate having a metal surface;

(b) a metal layer having less than about 1% by weight oxygen atoms based on the weight of the metal layer, bonded to the substrate metal surface, and wherein the metal layer has a composition different from the substrate metal surface;

(c) a charge blocking layer including a metal oxide over the metal layer, wherein the charge blocking layer is too thin to function as a light reflection preventive layer; and (d) at least one imaging layer, wherein the substrate metal surface comprises aluminum or aluminum alloy and the metal layer comprises nickel or nickel alloy.

2. The imaging member of claim 1, wherein the charge blocking layer has a thickness ranging from about 10 nm to about 1 micron.

3. The imaging member of claim 1, wherein the charge blocking layer has a thickness ranging from about 10 nm to about 100 nm.

4. The imaging member of claim 1, wherein the at least one imaging member layer includes a charge generating layer and a charge transport layer.

5. The imaging member of claim 1, wherein the at least one imaging member layer includes an organic charge generating material.

6. An electrostatographic imaging member comprising:

(a) a substrate having a metal surface;

(b) a metal layer having less than about 1% by weight oxygen atoms based on the weight of the metal layer, bonded to the substrate metal surface, and wherein the metal layer has a composition different from the substrate metal surface;

(c) a charge blocking layer including a metal oxide over the metal layer, wherein the charge blocking layer is too thin to function as a light reflection preventive layer; and (d) at least one imaging layer, wherein the substrate metal surface comprises an aluminum alloy and the metal layer comprises a material having a lower concentration by weight of aluminum than the aluminum alloy employed in the substrate metal surface.

7. The imaging member of claim 6, wherein the charge blocking layer has a thickness ranging from about 10 nm to about 1 micron.

8. The imaging member of claim 6, wherein the charge blocking layer has a thickness ranging from about 10 nm to about 100 nm.

9. The imaging member of claim 6, wherein the at least one imaging member layer includes a charge generating layer and a charge transport layer.

10. The imaging member of claim 6, wherein the at least one imaging member layer includes an organic charge generating material.

11. An electrostatographic imaging member comprising:

(a) a substrate having a metal surface;

(b) a metal layer having less than about 1% by weight oxygen atoms based on the weight of the metal layer, bonded to the substrate metal surface, and wherein the metal layer has a composition different from the substrate metal surface;

(c) a charge blocking layer including a metal oxide over the metal layer, wherein the charge blocking layer is too thin to function as a light reflection preventive layer; and (d) at least one imaging layer, wherein the substrate metal surface comprises a metal or metal alloy other than aluminum or aluminum alloy and the metal layer comprises a material that is other than aluminum or aluminum alloy.

12. The imaging member of claim 11, wherein the metal layer comprises a metal selected from the group consisting of nickel, copper, tantalum, tin, titanium, zirconium, palladium, zinc, hafnium, indium, and vanadium.

13. The imaging member of claim 11, wherein the metal layer is nickel and the metal oxide is nickel oxide.

14. The imaging member of claim 11, wherein the charge blocking layer has a thickness ranging from about 10 nm to about 1 micron.

15. The imaging member of claim 11, wherein the charge blocking layer has a thickness ranging from about 10 nm to about 100 nm.

16. The imaging member of claim 11, wherein the rest of the substrate has the same composition as the substrate metal surface.

17. The imaging member of claim 11, wherein the at least one imaging member layer includes a charge generating layer and a charge transport layer.

18. The imaging member of claim 11, wherein the at least one imaging member layer includes an organic charge generating material.

* * * * *